US010035632B2

(12) United States Patent
Birgen et al.

(10) Patent No.: US 10,035,632 B2
(45) Date of Patent: Jul. 31, 2018

(54) FOOD CONTAINER WITH FORCED MOISTURE REMOVAL

(71) Applicant: Kyllburg Technologies, LLC, Tempe, AZ (US)

(72) Inventors: William Birgen, Tempe, AZ (US); Hakim Hill, Tempe, AZ (US)

(73) Assignee: Kyllburg Technologies, LLC, Tempe, AZ (US)

( * ) Notice: Subject to any disclaimer, the term of this patent is extended or adjusted under 35 U.S.C. 154(b) by 85 days.

(21) Appl. No.: 14/709,365

(22) Filed: May 11, 2015

(65) Prior Publication Data

US 2015/0329265 A1 Nov. 19, 2015

Related U.S. Application Data

(60) Provisional application No. 61/993,949, filed on May 15, 2014.

(51) Int. Cl.

| | |
|---|---|
| ***B65D 81/26*** | (2006.01) |
| ***B65D 51/28*** | (2006.01) |
| ***B65D 43/02*** | (2006.01) |
| ***B65D 81/18*** | (2006.01) |
| ***B65B 25/00*** | (2006.01) |
| ***B65D 81/28*** | (2006.01) |

(52) U.S. Cl.

CPC ..... *B65D 51/28* (2013.01); *B65B 25/001* (2013.01); *B65D 43/02* (2013.01); *B65D 81/18* (2013.01); *B65D 81/26* (2013.01); *B65D 81/264* (2013.01); *B65D 81/28* (2013.01); *B65D 2251/0003* (2013.01)

(58) Field of Classification Search

CPC .. B65D 81/264; B65D 81/266; B65D 81/268; B65D 51/28; B65D 51/30; A47J 41/0044

USPC ..... 220/592.01, 574.3, 574.2, 574; 62/457.1, 62/457.2, 457.6, 457.9

See application file for complete search history.

(56) References Cited

U.S. PATENT DOCUMENTS

| | | | | |
|---|---|---|---|---|
| 4,498,586 | A | 2/1985 | Vitale | |
| 6,378,325 | B1 * | 4/2002 | Yang | A23B 7/0425 62/371 |
| 7,950,249 | B1 * | 5/2011 | White | F25D 3/08 62/457.1 |
| 2006/0016212 | A1 * | 1/2006 | Roth | A47J 41/0044 62/457.2 |
| 2008/0087037 | A1 * | 4/2008 | Rapaz | F25D 3/08 62/457.2 |
| 2008/0173650 | A1 * | 7/2008 | Roth | A47J 41/0044 220/574.1 |

(Continued)

*Primary Examiner* — Anthony Stashick
*Assistant Examiner* — Robert Poon
(74) *Attorney, Agent, or Firm* — Venjuris, P.C.

(57) ABSTRACT

A method, a food container, and a lid for a food container that actively removes moisture in the food container without changing the food temperature inside the container in a meaningful way are disclosed herein. The removal of moisture is achieved by introducing a cold spot inside the food container that forces condensation of moisture near the cold spot. The condensed moisture is then captured by an absorbent element placed below, and preferably adjacent to, the cold spot and between the cold spot and the stored food. The cold spot is preferably achieved by a properly chosen frozen substance such as an ice cube or a frozen gel packet.

6 Claims, 3 Drawing Sheets

(56) References Cited

U.S. PATENT DOCUMENTS

| | | | | |
|---|---|---|---|---|
| 2008/0302678 | A1* | 12/2008 | Hunwisk | B65D 25/04<br>206/222 |
| 2010/0005973 | A1* | 1/2010 | Doglioni Majer | B65D 75/38<br>99/295 |
| 2010/0320210 | A1* | 12/2010 | Cimmerer | B65D 75/22<br>220/367.1 |
| 2013/0008897 | A1* | 1/2013 | Rusnak | B65D 43/0231<br>220/23.89 |
| 2013/0056369 | A1* | 3/2013 | Jorgensen | C09J 7/04<br>206/204 |

* cited by examiner

FOOD CONTAINER WITH FORCED MOISTURE REMOVAL

CROSS-REFERENCE TO RELATED APPLICATION

The present application claims priority to a U.S. provisional patent application entitled "Food Container With Forced Moisture Removal," having Ser. No. 61/993,949, filed on May 15, 2014, which is entirely incorporated herein by reference.

BACKGROUND

Crispy or crunchy food stored in a food container becomes soggy after a very short period of time. Because of this, delivered or take-out food rarely tastes as good as it is served in a restaurant, and lunches prepared at home in the morning are not as delicious as they should be.

This problem is caused by moisture trapped in the food container. Existing solutions, such as US Patent Publication No. 2010/00320210, passively vent the trapped moisture out of the container. These solutions are limited because relying on air circulation alone, the moisture is not removed fast enough, or at least in an amount of time that is meaningful to avoid condensation inside the container, and eventually the moisture comes back to the food. In addition, by introducing ambient air from outside the container, the temperature inside changes, making hot food colder or salads warmer. Furthermore, since the replacement air that enters the vented container contains moisture as well, adopting these solutions results in introducing more moisture into the food container and the food.

Other strategies, such as US Patent Publication No. 2013/0056369, use absorbent materials placed on the interior side of the lid to absorb moisture. Like the solutions previously stated, the absorbent materials do not work well when a relatively large amount of moisture comes up from sizzling food.

Because the problem affects not only people's enjoyment of their lunches but also customer satisfaction of businesses that serve take-out food, food containers that quickly and effectively remove moisture in the containers are needed.

SUMMARY

The structure, overall operation and technical characteristics of the present invention will become apparent with the detailed description of preferred embodiments and the illustration of the related drawings as follows.

The invention is incorporated in a method, a food container, and a lid for a food container that actively removes moisture in the food container by introducing a localized cold spot inside the food container that forces condensation of the moisture at the cold spot. The condensed moisture is then captured by an absorbent element placed adjacent to the cold spot and between the cold spot and the stored food so that condensed moisture extracted from the air inside the food container is trapped and the food does not become soggy before consumption.

An exemplary food container may or may not be sealable, such as a covered salad bowl, a pizza box, or a Styrofoam® box. The localized cold spot may comprise any cold substance, such as an ice cube or a gel packet, and optionally a holder for the cold substance. The optional cold substance holder may at least include a bottom portion exposed to, preferably inside, the interior of the food container. The bottom portion may be made of materials with at least some heat transfer capability. An example of the cold substance holder is a small receptacle, such as a plastic sauce cup or a ramekin, attached to the lid on the interior side, after a cold substance, such as an ice cube, is contained inside.

For an embodiment of the food container that does not include a cold substance holder, the cold substance, such as a frozen gel packet, may be coupled to the lid and exposed to the interior of the food container. The cold substance is preferably frozen before use so that the intended condensation formation may be sufficiently fast and sustained. With a proper cold substance, the temperature of the cold spot is substantially at or below the dew point temperature. Therefore, the moisture inside the food container is exposed to the cold spot and condensation of vapor inside the container is forced to happen at a controlled localized feature.

Additionally, because the condensation of the moisture is forced, the absorbent element need not, but may, be substantially made of a desiccant element with hygroscopic qualities. Any absorbent materials including some inexpensive options such as paper towels, napkins, sponges, and tissues may be adopted as the absorbent element. The absorbent element is placed between the cold spot and the food, preferably adjacent to the bottom of the cold spot. In addition, it is preferred that the lid further comprises a drip member, placed between the absorbent element and the food, and preferrably coupled to the absorbent element, in order to prevent the absorbent element from releasing the captured condensate when reaching its saturation limit, which ideally would never happen. The drip member may be a tray or a film of materials that allows air but not water from moving in and out, such as a band aid.

Furthermore, in order to keep the temperature in the exemplary food container unaffected in a meaningful way, it is preferred that the cold spot comprises a frozen substance that is properly sized so that the heat released by the condensation phase change from vapor (to liquid) is offset by the heat absorbed by the phase change of the frozen substance to liquid. Alternatively, the heat released by the condensate formation may be absorbed by the frozen element without a phase change of the frozen substance to liquid. For example, an ice cube made from an ordinary ice cube tray may be sufficient for condensing the vapor moisture inside a lunch box containing hot food, and when the ice cube melts, the food temperature is substantially unchanged.

A preferred embodiment of a lid for a food container with forced moisture removal comprises: a cover, a cold substance holder coupled to the cover, and a moisture absorbent element coupled to the cold substance holder. The cold substance holder has a bottom portion oriented toward and exposed to an interior of the food container, and the moisture absorbent element is located between the bottom portion of the cold substance holder and food inside the food container. In addition, the exemplary lid may further comprises members stated above, such as a seal, a drip-proof member, and an opening for accommodating the cold substance holder.

In another preferred embodiment of the food container, the cold substance holder may be an independent inserted assembly that is self-supported and preferably removably coupled to the base of the food container. The exemplary cold substance holder may comprise a receptacle for holding the cold substance, such as a small cup or ramekin, and a stand for supporting the receptacle, such as a tripod. Alternatively, the cold substance holder may be merely a stand for supporting the cold substance, such as a pizza box tent for holding a frozen gel packet. See U.S. Pat. No. 4,498,586. Like the embodiments previously described, in this preferred embodiment, the absorbent element and the drip member are preferably placed near the cold spot, such as being attached to the bottom of the receptacle.

A preferred embodiment of the method for actively removing moisture from a food container comprises the following steps:

providing the following items:

the food container having a lid, a base coupled to the lid, and an interior space formed between the lid and the base, a cold substance holder having an interior bottom portion and an exterior bottom portion, and a moisture absorbent element coupled to the exterior bottom portion of the cold substance holder;

placing a frozen element, such as an ice cube or a gel packet, onto the interior bottom portion of the cold substance holder;

placing the cold substance holder in the interior space of the food container and coupling the cold substance holder to the food container, either at the lid or the base, with the exterior bottom portion oriented toward the base of the food container;

placing food inside the food container; and closing the food container.

Although the steps of the exemplary method are illustrated in a specific order, a person skilled in the art would know that the steps may be implemented in any alternate orders as long as forced condensation of moisture inside the food container is achieved and the condensed moisture is captured. In addition, the embodiment of the method may further comprises a step of providing a drip-proof member as illustrated above. Furthermore, the food container provided in this embodiment may have other members as stated above.

One object of this invention is to provide an effective and affordable solution for removing moisture inside a food container by forced moisture removal.

Another object of this invention is to provide an effective and affordable solution for removing moisture without affecting the temperature inside a food container in a meaningful way.

DESCRIPTION OF THE EMBODIMENTS

Figure 1:
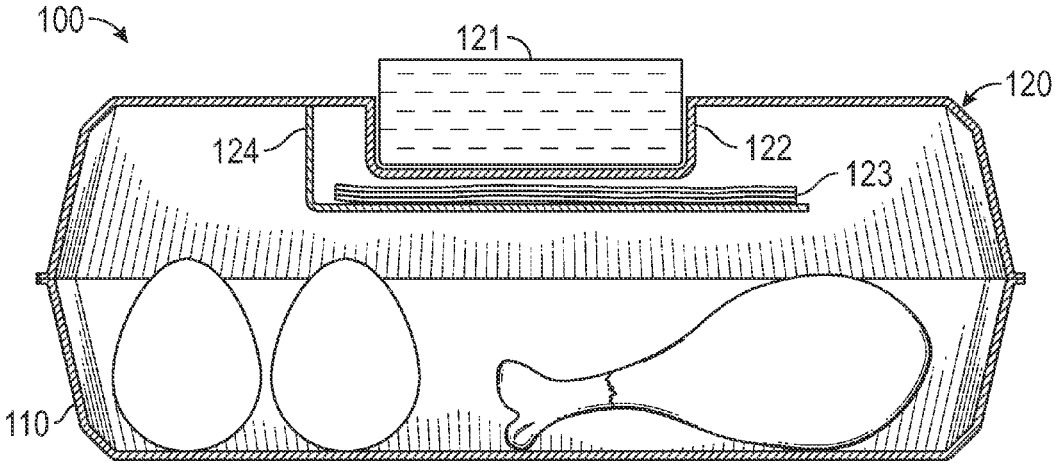
FIG. 1 shows a cross sectional view of an embodiment.

The preferred embodiments include a food container, a removable lid for a food container, and a method for removing moisture in the food container by forced condensation of the moisture and are illustrated in FIGS. 1-4. In FIG. 1, the preferred embodiment is a food box 100 with a base 110 and a lid 120. The base 110 may contain food, hot or cold. The lid 120 may comprise a frozen element 121, a compartment 122 for containing the frozen element 121, an absorbent material 123 placed below the frozen element 121 and the compartment 122, and a drip tray 124. The lid 120 and base 110 are coupled together to close the food box 100. Preferably, the food box 110 may have a seal (not shown) between the lid 120 and the base 110 to achieve a better insulation and moisture control.

The frozen element 121 of the embodiment 100 in FIG. 1 may be any proper cold substance such as an ice cube (frozen water) or a frozen gel packet that may induce condensation of vapor moisture. A suitable compartment for containing the frozen element may comprise a depressed area 122 on the lid 120 as shown in FIG. 1, with or without its own cover for closing the compartment. Alternatively, the compartment may be located above the rest of the lid. Either way, the bottom portion of the compartment may have at least some heat transfer capability for facilitating heat exchange between the frozen element and the vapor inside the food container.

In addition, the embodiment 100 in FIG. 1 further comprises an absorbent material 123 place inside the food container 100 and below, preferably very close to, the bottom portion of the compartment 122. The absorbent material 123 may be made of any suitable materials for capturing and isolating the condensed moisture, such as paper towel as adopted in this embodiment. The absorbent material 123 in FIG. 1 is supported by a drip tray 124, but it may alternatively be coupled to the interior side of the lid by any suitable means, such as adhesives and tapes, without contacting the tray. The drip tray 124 may be replaced by any drip member placed between the absorbent material and the stored food, such as a plastic film or a band-aid. An alternate embodiment may not have a drip tray or anything alike.

Figure 2:
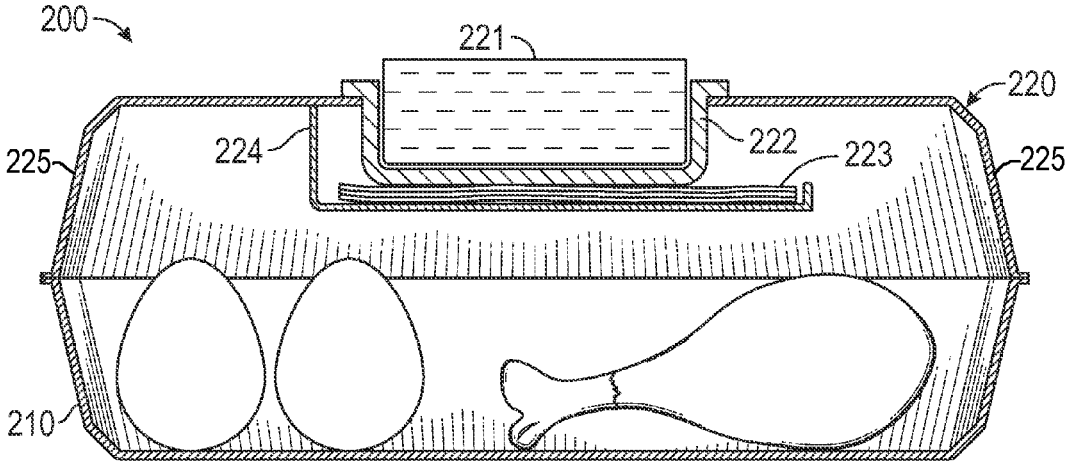
FIG. 2 shows a cross sectional view of an alternate embodiment.

An alternate embodiment 200 as shown in FIG. 2 is substantially similar to the previous embodiment 100. In this embodiment 200, the cold substance holder 222 is an insert of the lid 220 configured to hold a cold substance 221 and made of a thermal-conductive material. Since the cold substance holder 223 is separate from the cover 225, the cover 225 and the base 210 may be made of non-thermal-conductive materials so that the food inside is somewhat thermally insulated. In addition, the drip member 224, a drip tray, of this embodiment 200 has a raised edge configured to stop the moisture absorbent element 223 and released condensate, if any, from moving out of the tray.

Figure 3B:
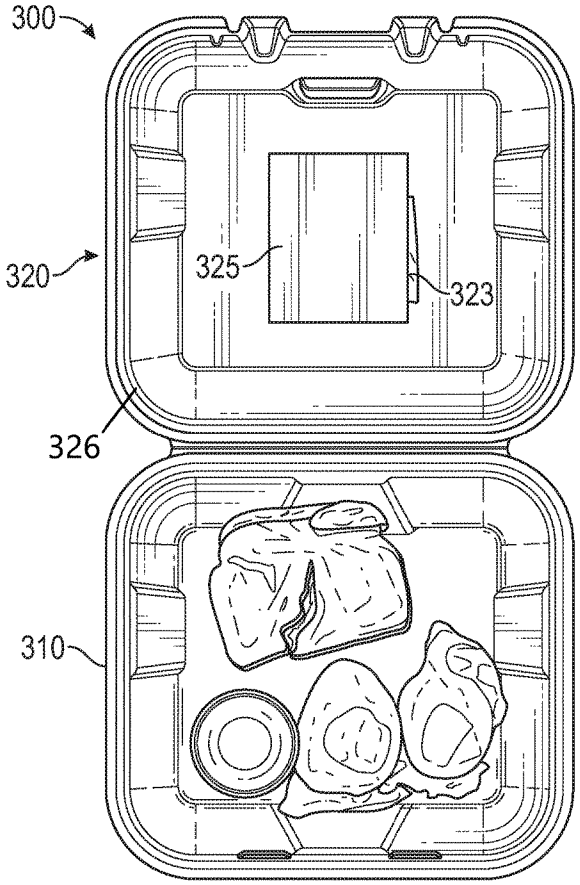
FIG. 3B shows a top view of the embodiment in FIG. 3A, with the lid open.
Figure 3A:
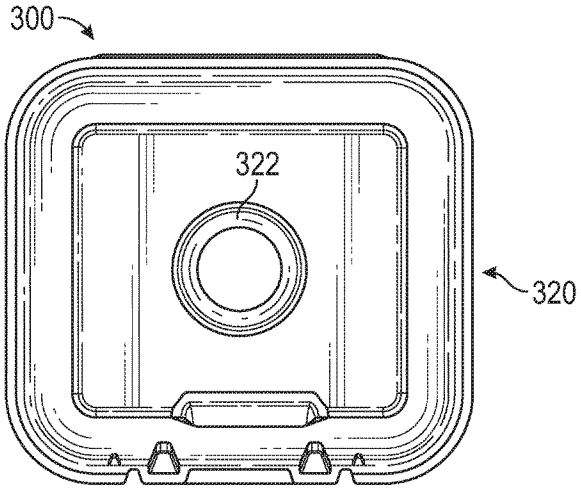
FIG. 3A shows a top view of another embodiment, with the lid closed.
Figure 3C:
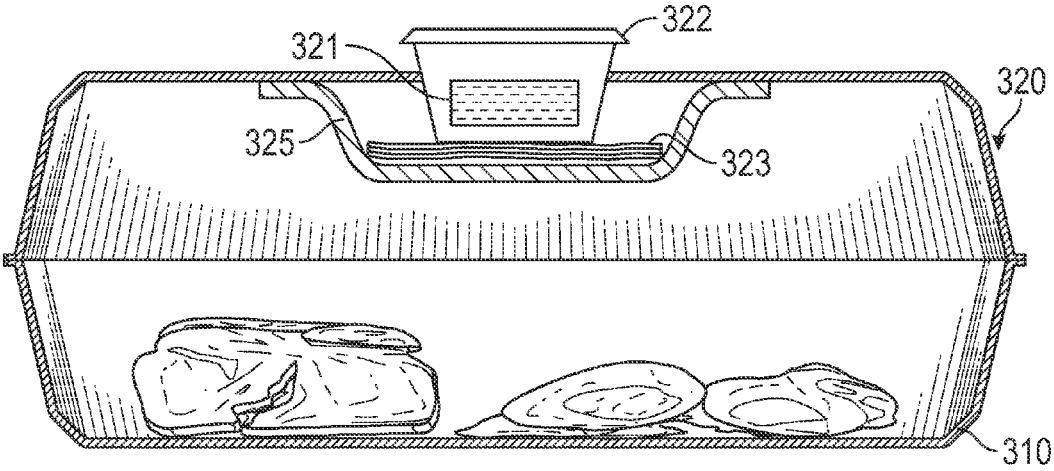
FIG. 3C shows a cross sectional view of the embodiment in FIG. 3A.

FIGS. 3A-3C show another embodiment 300. In this embodiment, the food container 300 is substantially made of Styrofoam®. A cold substance holder 322, a plastic sauce cup in this embodiment, is placed in a hole cut from the lid 320 and affixed to the lid 320. Right below the cold substance holder 322, a piece of paper towel 323, as an absorbent material, is coupled to a bottom of the cold substance holder 322 and the interior surface of the lid 320 by a band-aid-like, water resistant, and vapor permeable film 325, working as a drip member of the embodiment, and coupled to the moisture absorbent material 323. Like the embodiment 100, this food box 300 preferably has a seal 326 between the lid 320 and the base 310 (attached to the lid 320 in this embodiment 300) to achieve a better insulation and moisture control.

In an alternate embodiment, the food container is identical to the embodiment 300 except that the paper towel 323 is coupled to the lid 320 by duct tapes on four sides without any drip member. In an experiment with this alternate embodiment, hot food, including a crispy toast, 2 eggs, and a small container with boiling water, was placed inside the embodiment and an ordinary Styrofoam® box as a control food container, respectively. After that, the lids were closed and an ice cube slightly larger than a standard ice cube was placed in the sauce cup of the embodiment, which works as the cold substance holder. A short period later, the toast in the control food container became soggy while the toast in the embodiment was still crispy and hot. Therefore, the embodiment shows that the invention works as planned.

Figure 4:
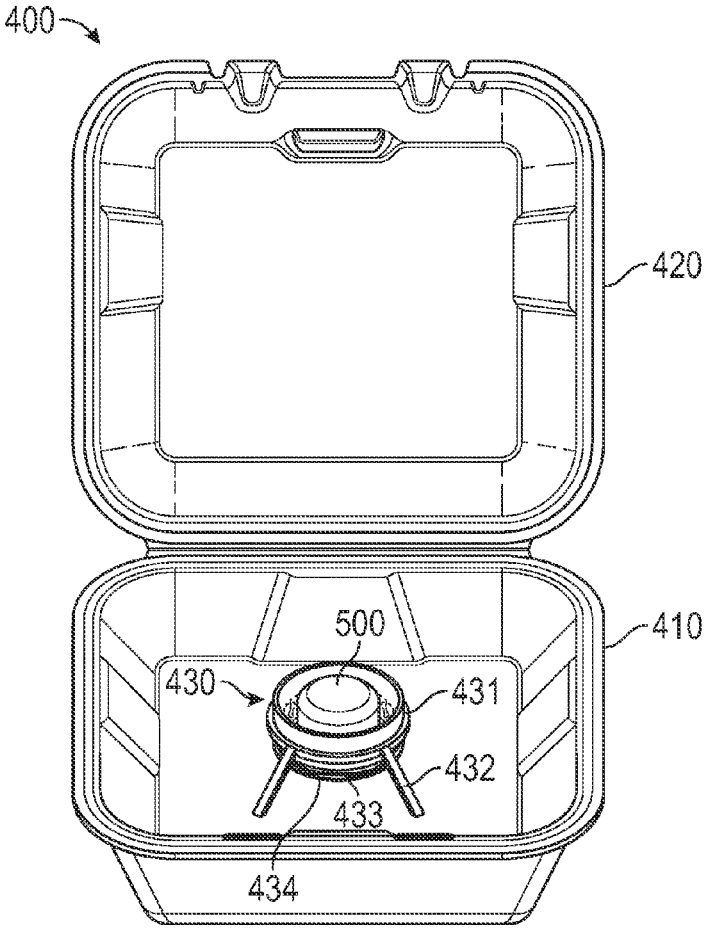
FIG. 4 shows a top view of another embodiment, with its lid open.

Another preferred embodiment is shown in FIG. 4. In this embodiment 400, the food container 400 comprises a base 410, a lid 420 coupled to the base 410, and a cold-substance holding assembly 430 removably coupled to the base 410. The cold substance holding assembly 430 comprises a receptacle 431 configured to hold a cold substance 500, a stand 432 coupled to and configured to elevate the receptacle 431, a moisture absorbent element 433 coupled to a bottom of the receptacle 431, and a drip member 434 coupled to and placed beneath the moisture absorbent element 433. The receptacle 431 in this embodiment 400 may or may not have a cover. In another embodiment where the bottom of the receptacle has little heat transfer capability, the forced condensation may occur mostly above the receptacle, and therefore, the cold substance holding assembly may not include a moisture absorbent element or a drip member.

While the invention has been described by means of specific embodiments, numerous modifications and variations could be made thereto by those ordinarily skilled in the art without departing from the score and spirit disclosed herein.

The invention claimed is:

1. A method for actively removing moisture from a food container, the method comprising the steps of:

(a) providing:

(i) the food container having a lid, a base coupled to the lid, and an interior space formed between the lid and the base, (ii) a cold substance holder having an interior bottom portion and an exterior bottom portion, and (iii) a moisture absorbent element coupled to the exterior bottom portion of the cold substance holder;

(b) placing a frozen element onto the interior bottom portion of the cold substance holder;

(c) placing the cold substance holder in the interior space of the food container and coupling the cold substance holder to the food container with the exterior bottom portion oriented toward the base of the food container;

(d) placing food inside the food container; and (e) closing the food container, wherein the frozen element comprises a volume predetermined based on a volume of the interior space of the food container in order to maintain a temperature in the interior space.

2. The method in claim 1, wherein the lid of the food container further comprises a drip member coupled to the moisture absorbent element, located between the moisture absorbent element and the food inside the food container.

3. The method in claim 2, wherein the drip member is a tray.

4. The method in claim 2, wherein the drip member is a water resistant and vapor permeable film.

5. The method in claim 1, wherein the lid of the food container further comprises an opening for accommodating the cold substance holder while exposing the exterior bottom portion of the cold substance holder to the interior space of the food container.

6. The method in claim 1, wherein the lid of the food container further comprises a seal coupled to the lid.

* * * * *